US006279333B1

(12) United States Patent
Cilli et al.

(10) Patent No.: US 6,279,333 B1
(45) Date of Patent: Aug. 28, 2001

(54) MOBILE INDUSTRIAL AIR COOLING APPARATUS

(75) Inventors: Marc A. Cilli; Gabriel P. Cilli, both of New Castle, PA (US)

(73) Assignee: Industry Heating and Cooling, Inc., New Castle, PA (US)

( * ) Notice: Subject to any disclaimer, the term of this patent is extended or adjusted under 35 U.S.C. 154(b) by 0 days.

(21) Appl. No.: 09/524,892

(22) Filed: Mar. 14, 2000

(51) Int. Cl.[7] ..... F25D 15/00

(52) U.S. Cl. ..... 62/237; 122/390; 165/109.1; 62/238.6

(58) Field of Search ..... 62/237, 238.6; 122/390, 402, 406.3; 165/109.1

(56) References Cited

U.S. PATENT DOCUMENTS

| | | | | |
|---|---|---|---|---|
| 3,228,205 | | 1/1966 | Franklin | 62/237 |
| 4,141,222 | * | 2/1979 | Ritchie | 62/238.6 |
| 4,474,018 | * | 10/1984 | Teagan | 62/238.6 |
| 4,558,571 | * | 12/1985 | Yoshinaga et al. | 62/238.6 |
| 4,588,024 | * | 5/1986 | Murray et al. | 165/109.1 |
| 4,790,291 | * | 12/1988 | Barrett | 122/390 |
| 4,835,977 | | 6/1989 | Haglund et al. | 62/89 |
| 4,901,538 | * | 2/1990 | Anthony | 62/237 |
| 5,056,331 | | 10/1991 | Lotz | 62/237 |
| 5,471,851 | * | 12/1995 | Zaknyk | 62/238.6 |
| 5,491,980 | | 2/1996 | Yingst et al. | 62/237 |
| 5,573,182 | * | 11/1996 | Gannaway et al. | 62/238.6 |
| 5,953,929 | | 9/1999 | Bauman et al. | 62/259.1 |

* cited by examiner

*Primary Examiner*—William E. Tapolcai
(74) *Attorney, Agent, or Firm*—Harpman & Harpman

(57) ABSTRACT

A self-contained mobile air-cooling apparatus that can be moved to specific areas for auxiliary or primary cooling as needed. The cooling apparatus has a refrigeration compressor interconnected to an expansion evaporator coil and a condenser coil. A blower draws in ambient air via a return opening and through the evaporator coil giving off cooled air. Refrigerant from the evaporator coil is circulated through a water cooled condenser coil in an enclosure giving up its heat to the water. The water is circulated over the condenser coil in the enclosure and selectively to a storage tank via an outlet control valve.

7 Claims, 3 Drawing Sheets

MOBILE INDUSTRIAL AIR COOLING APPARATUS

BACKGROUND OF THE INVENTION

1. Technical Field

This invention relates to air conditioning and refrigeration systems that use compressors and blowers to cool ambient air and more particularly to so-called spot cooling equipment in industry that is moved from location to location for remote cooling needs.

2. Description of Prior Art

Prior art devices of this type use an evaporator coil supplied with refrigerant from a compressor. Air is circulated over the coil and gives up its heat to the refrigerant as it expands. Return refrigerant from the evaporator coil is circulated through an air-cooled condenser coil and back to the compressor. Examples of such cooling systems can be seen in U.S. Pat. Nos. 3,228,205, 4,835,977, 5,056,331, 5,491,980 and 5,953,929.

In U.S. Pat. No. 3,228,205 a palletized refrigeration unit for transportation vehicles is disclosed having a container of eutectic liquid that is initially frozen by a refrigeration system before it is loaded into the trailer. After palletized refrigeration unit has been secured within the trailer, a low amperage fan motor re-circulates air over the frozen container cooling the interior of the trailer.

U.S. Pat. No. 4,835,977 discloses an apparatus to cool parked aircraft. A cooling unit that provides conditioned air at a temperature below freezing point of water under pressure is positioned adjacent to the aircraft supplying same with super cooled air.

U.S. Pat. No. 5,056,331 claims an enclosure for electronic equipment having an air-cooled air conditioning unit within the enclosure so as to cool the electronic equipment. Ambient room temperature air is drawn into the air conditioning unit, cooled and circulated throughout the enclosure.

U.S. Pat. No. 5,491,980 illustrates a reversible refrigeration/freezer system in which the refrigeration mechanism is in a separate cabinet from the enclosure to be cooled. Universal inlets and outlets are provided so the refrigerant unit can be interchanged on different sides of the enclosure for heating or freezing of same.

U.S. Pat. No. 5,953,929 on a modular refrigeration unit discloses a system having all the components of the system mounted on an integral base. The system uses a typical compressor, an evaporator coil with a blower and a condensate coil over which air is circulated for the cooling process.

SUMMARY OF THE INVENTION

A modular mobile air-cooling apparatus that utilizes a water cooled condenser coil to eliminate the returning of heated air into the ambient air in which the apparatus has been placed. The condensate coil is submerged within a water tank with circulating cooling water within. Water is circulated through the cooling tank by a circulation pump and control valves. Inlet and outlet on the tank are used to remove heated water to a storage enclosure that is used as a source of pre-heated water for related applications.

DESCRIPTION OF THE PREFERRED EMBODIMENT

Figure 1:
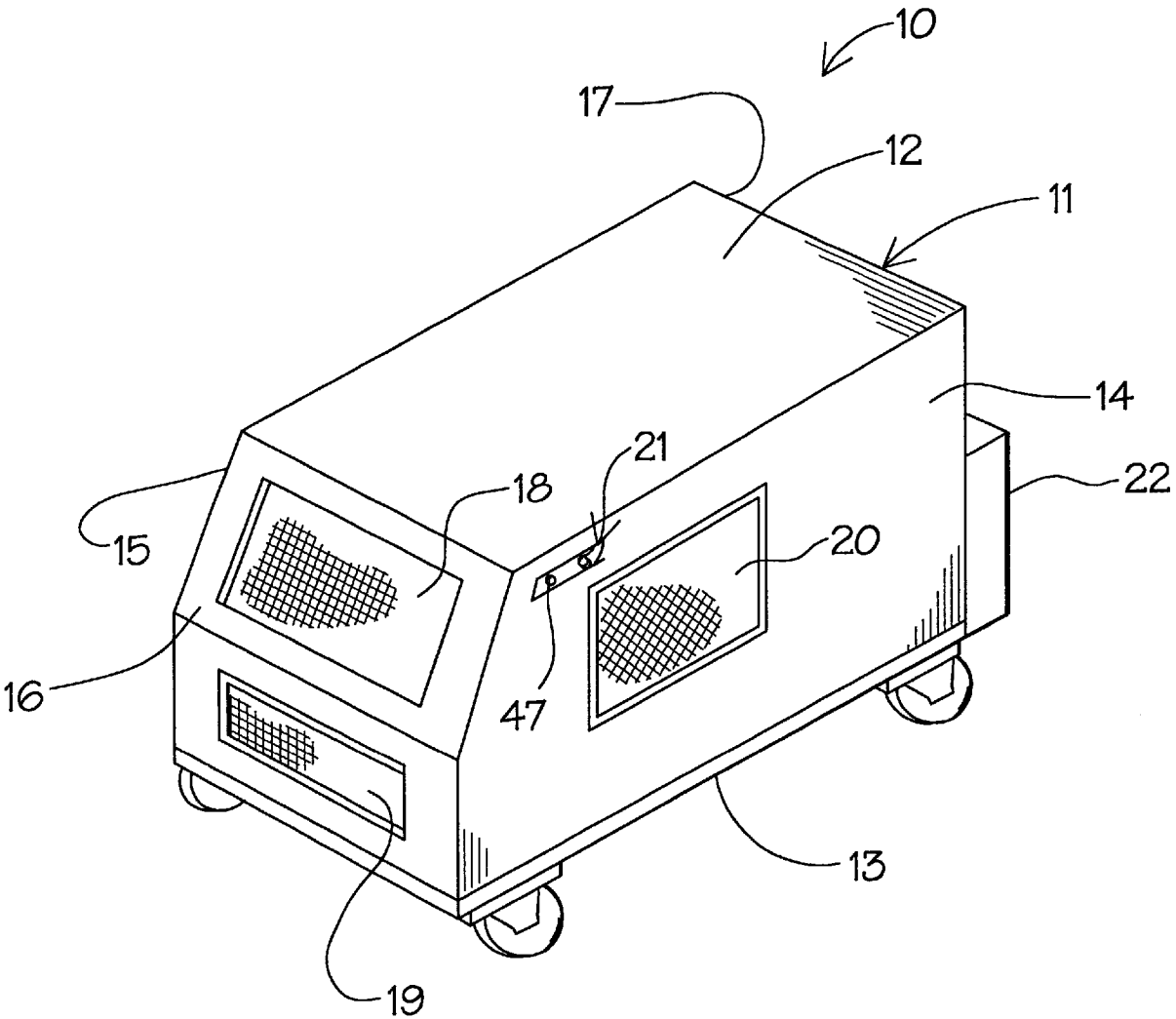
FIG. 1 is a perspective view of the mobile air-cooling apparatus of the invention.
Figure 2:
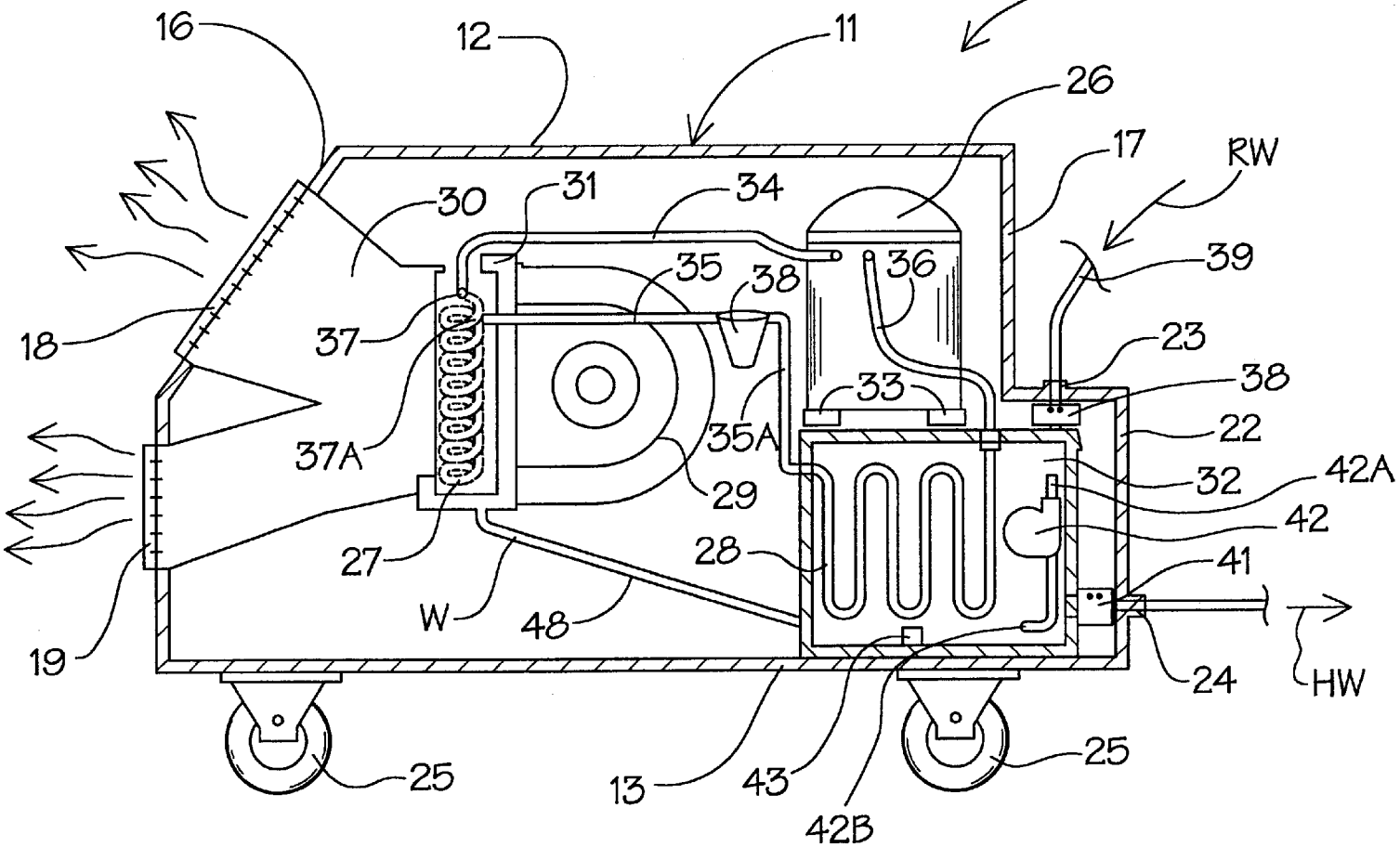
FIG. 2 is a partial sectional view of the mobile air cooling apparatus illustrating structural details and relationship of interior components.

Referring to FIGS. 1 and 2 of the drawings, a mobile air cooling apparatus 10 of the invention can be seen having an enclosure 11 which has top 12, bottom 13 and oppositely disposed sidewalls 14 and 15 and interconnecting end panel portions 16 and 17. The end panel 16 has a pair of discharge openings 18 and 19 within and the side panel 14 has a return opening 20 and a control panel 21 positioned thereon. The opposite end panel 17 has an extended portion 22 with water inlet and outlet fittings 23 and 24 respectively.

In this example chosen for illustration, a set of coaster wheels 25 are positioned on the bottom 13 so as to provide mobility to the enclosure 11 as will be well understood by those skilled in the art.

The cooling system 10 can be seen including a compressor 26, and interconnected evaporator coil 27, a condenser coil 28 and a blower 29. The evaporator coil 27 is mounted on a housing 30 extending to respective discharge openings 18 and 19 as hereinbefore described. The blower 29 is mounted to the evaporator coil 27 by a support bracket 31 and when activated will draw in ambient room air through the return opening 20 and force same through the evaporator coil 27 as indicated by the airflow arrows in the drawings. The condensing coil 28 of the system 10 is submerged within an enclosed water filled cooling tank 32 positioned in the lower portion of the enclosure 11. The compressor 26 is positioned on top of the cooling tank 32 on resilient mounting pads 33. Refrigerant supply line 34 and return suction lines 35, 35A and 36 interconnect the compressor 26 with the evaporation coil 27 and condensate coil 28 forming a closed refrigeration loop of the system.

The refrigerant supply line 35 extends from the condensate coil 28 through an expansion valve 38 to an inlet port 37A on the evaporator coil 27. Correspondingly, the return suction line 34 extends from an outlet port 37 on the evaporator coil 27 through the compressor 26 into the condenser coil 28 via return line 36 which, as noted above, is positioned within the cooling tank 32.

The cooling tank 32 has a solenoid controlled water supply inlet valve 38 interconnected with the hereinbefore-described inlet fitting 23 and a source of water indicated at 39. A solenoid controlled outlet water valve 41 is interconnected with the outlet fitting 24 on the enclosure 11 providing controlled coolant water outlet for the cooling tank 32.

Figure 3:
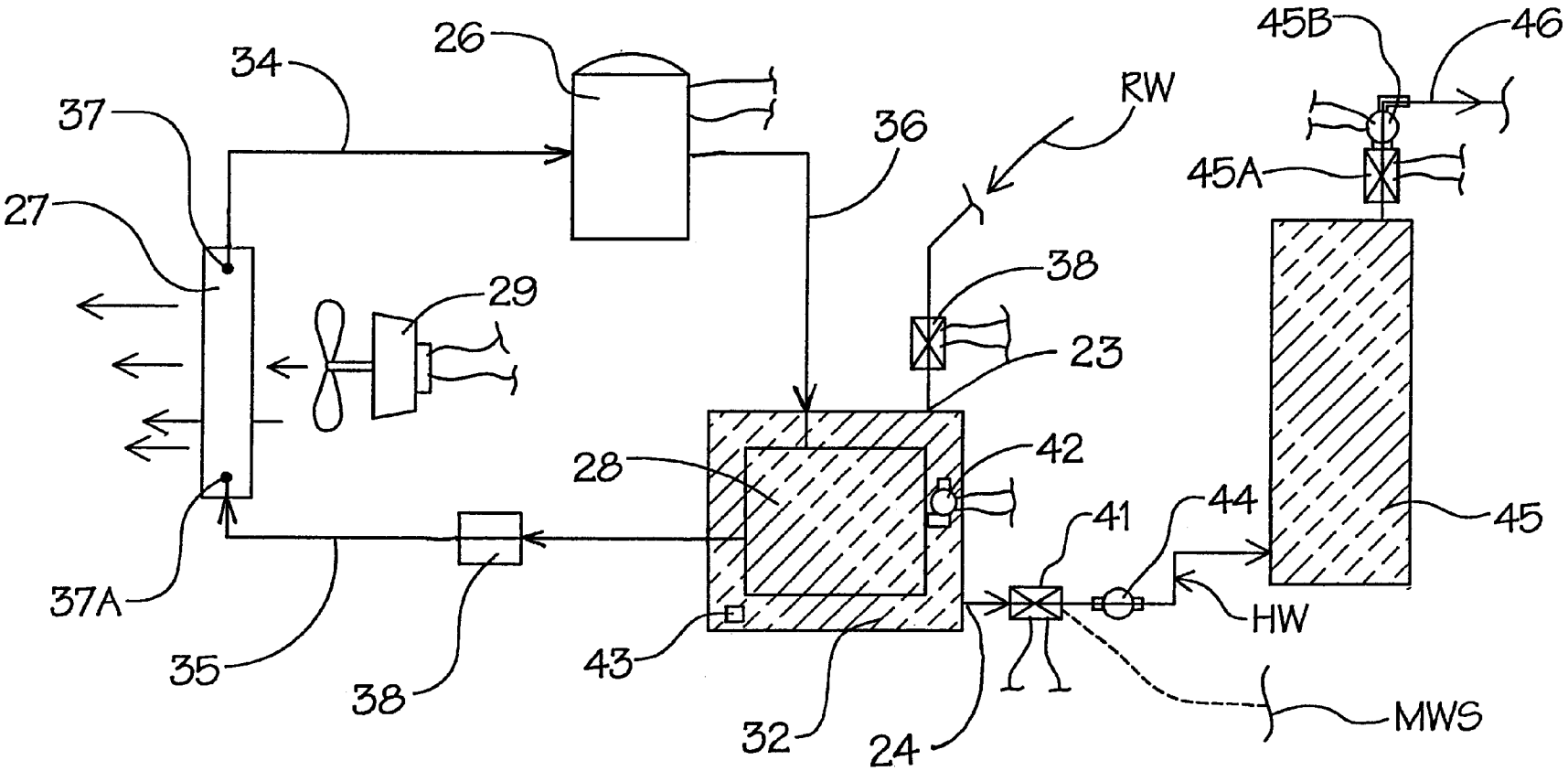
FIG. 3 is an illustrative flow diagram of the components of the invention including an auxiliary water storage tank.

In use, the cooling system 10 of the invention operates in a modified conventional manner as follows. The compressor 26 circulates liquid refrigerant through the evaporator 27 and condenser coil 28 indicated by directional flow arrows in FIG. 3 of the drawings. In the evaporator coil 27, the refrigerant vaporizes drawing heat from the ambient air that was drawn into the enclosure by the blower 29 and forced through the evaporator coil 27. Expanded refrigerant exits the evaporator coil 27 via an outlet and suction line 34 to the compressor 26 being compressed and then to the condensing coil 28 submerged within the water filled tank 32. The refrigerant supply line 36 extends from the compressor 26 to the condenser coil 28.

As best seen in FIG. 2 of the drawings, a circulation pump 42 within the cooling tank 32 has a pump inlet 42A and a pump outlet at 42B in spaced relation to one another so as to circulate the water within the tank 32 about and over the condensing coil 28 therein. Once the water within the tank 32 reaches a pre-determined temperature a remote bulb sensor thermostat 43 activates the solenoid operated outlet valve 41 and auxiliary pump 44 drawing off heated tank water HW as indicated by arrows in FIG. 3 of the drawings. Cold replacement water RW is supplied via a solenoid actuated valve 38 on the inlet fitting 23 to replenish the cooling tank 32. The heated water HW is stored temporarily in a storage tank 45 and can be used for a variety of hot water related applications by a control valve 45A, pump 45B and associated outlet line 46.

Alternately, the heated water HW from the cooling tank 32 can be disposed of directly from the tank via the same solenoid outlet valve 41 to a municipal water waste line MWS, if available, as shown in broken lines.

An air temperature thermostat 47 on the control panel 21 of the enclosure 11 controls the mobile air-cooling apparatus 10 of the invention cycling the unit on and off depending on the ambient air temperature in which it is positioned.

It will be evident from the above description that the relative efficiency of the air-cooling apparatus 10 of the invention is enhanced by the water cooling of the condensate coil 28 over that of a conventional traditional air cooled condensing coil using hot ambient air of the surround area for cooling.

In operation, the evaporator coil 27 will typically produce condensate water W from the ambient air stream as when circulating over a cold surface. The condensate water W is collected at the bottom of the coil 27 and directed through an outlet pipe 48.

It will thus be seen that a new and useful mobile air conditioning system has been illustrated and described and it will be apparent to those skilled in the art that various changes and modifications may be made therein without departing from the spirit of the invention.

Therefore I claim:

1. A mobile air cooling system comprising, an enclosure, air openings in said enclosure, a cooling mechanism within said closure, said cooling mechanism including a compressor assembly, evaporator coil, a condenser coil, and an expansion valve between said respective coils, a cooling tank having a liquid inlet valve in communication with a source of cooling fluid and a liquid outlet valve, said condenser coil positioned within said cooling tank, said compressor, evaporator coil and condenser coil arranged in interconnecting closed loop circuit, means for circulating ambient air through said evaporator coil and a circulation pump within said cooling tank for circulating liquid around said condenser coil.

2. The mobile air cooling system set forth in claim 1 wherein said means for circulating ambient air through said evaporator coil comprises, a blower assembly mounted adjacent said evaporator coil, an air intake in said enclosure and at least one conditioned air outlet in said enclosure in communication with said evaporator coil.

3. The mobile air-cooling system set forth in claim 1 wherein said liquid inlet valve has a first solenoid assembly in communication therewith.

4. The mobile air-cooling system set forth in claim 1 wherein said liquid outlet valve has a second solenoid assembly in communication therewith.

5. The mobile air-cooling system set forth in claim 1 wherein said circulation pump within said cooling tank has an inlet and positive flow outlet within said tank, said inlet in spaced relation to said positive flow outlet.

6. The mobile air cooling system set forth in claim 1 wherein said circulating liquid in said cooling tank is water.

7. The mobile air-cooling system set forth in claim 1 wherein said liquid outlet valve is in communication with a liquid storage tank.

* * * * *